US005826157A

United States Patent [19]

Wierszewski

[11] Patent Number: 5,826,157

[45] Date of Patent: Oct. 20, 1998

[54] SYCHRONIZED PAPER FEEDING ACROSS MODULE BOUNDARIES WITH TIMED CLOCK TICKS

[75] Inventor: Ronald R. Wierszewski, Henrietta, N.Y.

[73] Assignee: Xerox Corporation, Stamford, Conn.

[21] Appl. No.: 903,808

[22] Filed: Jul. 31, 1997

[51] Int. Cl.[6] ..... G03G 15/00

[52] U.S. Cl. ..... 399/396; 271/270; 347/153; 364/478.16

[58] Field of Search ..... 399/16, 77, 394, 399/396; 347/139, 153, 264; 271/10.03, 270, 258.01; 364/478.16

[56] References Cited

U.S. PATENT DOCUMENTS

| | | | |
|---|---|---|---|
| 3,564,960 | 2/1971 | Foulks | 83/203 |
| 4,427,287 | 1/1984 | Matsumoto et al. | 355/14 SH |
| 4,519,700 | 5/1985 | Barker et al. | 399/394 |
| 4,579,444 | 4/1986 | Pickney et al. | 355/14 SH |
| 4,785,325 | 11/1988 | Kramer et al. | 355/8 |
| 4,892,426 | 1/1990 | Steele | 400/708 |
| 5,050,859 | 9/1991 | Paxon | 271/270 |
| 5,339,139 | 8/1994 | Fullerton et al. | 355/215 |
| 5,423,527 | 6/1995 | Tranquilla | 271/10 |
| 5,461,468 | 10/1995 | Dempsey et al. | 355/316 |
| 5,489,969 | 2/1996 | Soler et al. | 355/207 |
| 5,559,595 | 9/1996 | Farrell | 355/325 |
| 5,596,389 | 1/1997 | Dumas et al. | 399/16 |

*Primary Examiner*—Joan Pendegrass
*Attorney, Agent, or Firm*—John S. Wagley

[57] ABSTRACT

A method for tracking the position of a sheet through a paper path being translated by a plurality of feed mechanisms within a printing machine is provided. The method includes the steps of driving a first feed mechanism with the motion of a first drive means, placing the sheet in cooperation with the first feed mechanism at a first position, translating the sheet with the first feed mechanism toward a second feed mechanism, driving the second feed mechanism with the motion of a second drive means, placing the sheet in cooperation with the second feed mechanism at a second position, translating the sheet with the second feed mechanism toward a the sheet output position, the paper path being defined by the motion of the sheet through the first feed mechanism and the second feed mechanism from the first position to the sheet output position and calculating the distance the sheet traverses while influenced by one of the first drive means and the second drive means based at least partially upon the motion of the other of at least one of the first drive means and the second drive means.

18 Claims, 5 Drawing Sheets

SYCHRONIZED PAPER FEEDING ACROSS MODULE BOUNDARIES WITH TIMED CLOCK TICKS

The present invention relates to feeding substrates through an electrophotographic printing machine. More particularly, the invention relates to feeding substrates in a synchronized manner from an adjacent module to a printer module.

Cross reference is made to the following application filed concurrently herewith: Attorney Docket Number D/96424 Ser. No. 08/904,013 entitled "Synchronized Insert Feeding Across Module Boundaries" by Ronald R. Wierszewski.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

High speed copying machines are becoming increasingly popular. These machines have a capacity or output capacity of say, for example, over 60 copies per minute. These machines are able to use single cut sheets of paper of various size such as A4, 8 ½×11, or 8 ½×14 inch copy sheets. These machines may be of the light lens, xerographic machine or may be a printer with digital input. Single, cut sheet printing machines are now available at speeds around 200 cpm.

The new high speed printing machines typically include a plurality of paper trays for storing copy substrate for use in the printing machine. These trays hold a sizable amount of sheets, for example, from 200 to 1,000 sheets per tray. As such, with 2,000 sheet storage capacity within the trays of the machine, the trays may be depleted within ten minutes. Further, the number of trays may be limited to three or less allowing the immediate availability of only three different types of copy sheets. Therefore, there is a need for additional copy sheet capacity as well as for availability of more different types of copy sheets within the printing machine.

One answer to the problem with providing enough quantity and variety of copy sheets for a copy machine is the use of an interposer. An interposer is a sheet feeding section for a printing system that may be interposed or placed between the printing engine of the printing system and the output tray or finisher of the printing system. The interposer includes additional paper trays to provide additional copy sheet capacity as well as additional options for copy sheet type to be stored within the machine.

The primary output product for a typical electrostatographic printing system is a printed copy substrate such as a sheet of paper bearing printed information in a specified format. Quite often, customer requirements necessitate that this output product be configured in various specialized arrangements or in print sets ranging from stacks of collated loose printed sheets to tabulated and bound booklets.

In that the requirements for customers vary for high speed printing machines, interposers as described above are typically optional additions to the printing machines. Therefore, printing engines and finishers are designed to be separable from each other and an interposer optionally connected therebetween. The interposer thus is preferably a separable, completely independent unit that may be added with the machine as installed or as an upgrade later. The printing machine is therefore typically driven by a mechanism separate and independent from the driver for the interposer. However, sheets from the interposer must interact, cooperate and coordinate with sheets from the printing engine. Sheets that begin in the interposer may enter into the printing engine and back across the interposer to the finisher. Likewise, sheets may begin in the interposer and meet with sheets in the printing engine in the interposer to form sets of sheets in the finisher. Therefore, it is important that the sheets within an interposer and sheets within a printer be tracked and coordinated through both modules.

To allow for the alternating of the sheets from a first bin to a second bin, copy machines typically have what is know as a "skip" pitch. A skip pitch is a missing sheet or a plurality of missing sheets within the stream of copy paper through the printer. These skip pitches allow time for the mechanism within the bin sorter to readjust when moving from the last sheet of a first set of copies to the first sheet of a second set of copies to be later finished.

The motor and feed mechanism utilized to drive the sheets within a printing engine and the feed mechanism and motor utilized to translate the sheets within the interposer tend to operate independently and have their own errors and inconsistencies. Sheets that are driven by the interposer mechanism must mate with sheets driven by the print engine feed mechanism and to provide proper registration must meet with extreme precision and accuracy. This is particularly difficult for the machines described above running at speeds of as high as 200 cpm.

The synchronized insert feeder of the present invention is intended to alleviate at least some of the problems heretofore mentioned.

The following disclosures relate to the area of inserting one or more insert sheets among a plurality of previously marked sheets:

- U.S. Pat. No. 5,596,389 Patentee: Dumas et al. Issued: Jan. 21, 1997
- U.S. Pat. No. 5,559,595 Patentee: Farrell Issued: Sep. 24, 1996
- U.S. Pat. No. 5,489,969 Patentee: Soler et al. Issued: Feb. 6, 1996
- U.S. Pat. No. 5,461,468 Patentee: Dempsey et al. Issued: Oct. 24, 1995
- U.S. Pat. No. 5,423,527 Patentee: Tranquilla Issued: Jun. 13, 1995
- U.S. Pat. No. 5,339,139 Patentee: Fullerton et al. Issued: Aug. 16, 1994
- U.S. Pat. No. 4,892,426 Patentee: Steele Issued: Jan. 9, 1990
- U.S. Pat. No. 4,785,325 Patentee: Kramer et al. Issued: Nov. 15, 1988
- U.S. Pat. No. 4,579,444 Patentee: Pinckney et al. Issued: Apr. 1, 1986
- U.S. Pat. No. 4,427,287 Patentee: Matsumoto et al. Issued: Jan. 24, 1984
- U.S. Pat. No. 3,564,960 Patentee: Foulks Issued: Feb. 23, 1971

The relevant portions of the foregoing disclosures may be briefly summarized as follows:

U.S. Pat. No. 5,596,389 discloses a scheduling apparatus for a printing system. The scheduling apparatus includes a memory for storing a set of two or more feed signals. The set of feed signals includes a first feed signal and a second feed signal with the first feed signal and the second feed signal corresponding respectively with a special sheet and an imaginable regular substrate having opposing sides. The scheduling apparatus further includes a controller for generating the first and second feed signals. The controller which communicates with each of a print engine and a special sheet insertion apparatus determines whether the imaginable regular substrate is to be imaged on both of the opposing sides and, when it is determined that the imaginable regular substrate is to be imaged on both the opposing sides, the controller schedules the first and second feed signals to be transmitted respectively to the print engine and the special sheet insert apparatus during a single pitch.

U.S. Pat. No. 5,559,595 discloses a special sheet handling apparatus for use with a printing system. The printing system includes a print engine. The special sheet handling apparatus includes a special sheet insertion path operatively coupled with the print engine. Substrates, each having a stock orientation and being imaged with the print engine, are delivered to the special sheet insertion path as output, while a special sheet, having a special sheet orientation, when disposed in the special sheet insertion path, is added to the output by the special sheet handling orientation. A processor determines whether the stock orientation is the same as the special sheet orientation. When the orientations are different, and the special sheet is invertable, the special sheet is inverted at an inverting station communication with the special sheet insertion path.

U.S. Pat. No. 5,489,969 discloses a technique for controlling the interposition of one or more special sheets into a stream of regular imaged substrates. In one example, a point in time at which a special insert sheet should be fed from a special insertion sheet subsystem to the stream is determined by reference to plural sheets of preset time periods. In this example, the preset time periods can be adjusted to accommodate print engine/interposing module machine clock fluctuations. In another example, interposition of a special inserter sheet with the stream of regular imaged substrates is maintained at an acceptable level by comparing a distance between a special insert sheet fed to the stream and an adjacent regular imaged substrate with a predefined tolerance. The comparison can then be used to adjust feed times of special insert sheets subsequently fed to the stream.

U.S. Pat. No. 5,461,468 discloses a document handler interdocument gap control system. A first servo drive feeds document in a first path portion and a second servo drive feeds documents in the second path portion. A sheet edge sensor in the first path portion signal the passage of the lead or trail edge of document sheets.

U.S. Pat. No. 5,423,527 discloses a method of processing documents by moving them from an input hopper to a destination site at a controlled rate. The method includes driving each document into a feed path from the input hopper at an adjustable time period after a previous document has been feed, then sensing the distance separating the documents and adjusting the time period between driving of succeeding documents to achieve a desired gap.

U.S. Pat. No. 4,892,426 discloses a paper movement monitor for monitoring the movement of paper through a printer. The monitor includes sensors in the form of photo-optical wheels which are in rolling contact with the paper and sense the position of the paper.

U.S. Pat. No. 4,785,325 discloses a document imaging system including a mechanism for adjusting the speed ratio between the document scanning system and the photoreceptor. A timing belt is connected between an adjustable tapered portion of a drive pulley mounted on the photoreceptor drive shaft and the document scanning system. The portion of the tapered surface on which the belt is driven is axially adjustable resting in a change in scanning speed.

U.S. Pat. No. 4,579,444 discloses a document registration system for use in a document feeder of a copier. The registration system includes a control system for controlling document platen transport to stop at a desired calculated position. The system includes a sensor and upstream of the trailing edge of a document. The sensor provides a signal indicative of the size of the copy sheet. and calculates a stopping position on the platen based on the selected copy reduction size.

U.S. Pat. No. 4,427,287 discloses a copying machine having an automatic document feeder. The copy machine has a single motor for driving a feed mechanism for the main body and a feed mechanism for the automatic document feeder. A timing disk is coupled to the motor for supplying a timing signal. Based on this signal, a CPU controls the operation of the copy machine.

U.S. Pat. No. 3,564,960 discloses a copy machine copy paper length error compensating system. As an original moves forward, a trailing edge sensor sends an initial cutting signal to a super-precise electronic timer having a capacitor. The charging interval of the capacitor is controlled to maintain cut length of the sheet.

As will be seen from an examination of the cited prior art, it is desirable to provide an electrostatographic copying machine with the ability to have a printing engine tray and auxiliary paper trays to coordinate and time the travel of the sheets from the two type of trays. The inaccuracies and differences between the driving of the copy sheets within the interposer or auxiliary copy section and the print engine results in misregistration of sheets and lower copy quality. This invention is directed to improving the accuracy of the feeding of copy sheets from an auxiliary printing tray into the copying module.

In accordance with one aspect of the invention, there is provided a method for tracking the position of a sheet through a paper path being translated by a plurality of feed mechanisms within a printing machine. The method includes the steps of driving a first feed mechanism with the motion of a first drive means, placing the sheet in cooperation with the first feed mechanism at a first position, translating the sheet with the first feed mechanism toward a second feed mechanism, driving the second feed mechanism with the motion of a second drive means, placing the sheet in cooperation with the second feed mechanism at a second position, and translating the sheet with the second feed mechanism toward a sheet output position. The paper path is defined by the motion of the sheet through the first feed mechanism and the second feed mechanism from the first position to the sheet output position. The method further includes the steps of calculating the distance the sheet traverses while influenced by one of the first drive means and the second drive means based at least partially upon the motion of the other of at least one of the first drive means and the second drive means.

In accordance with another aspect of the present invention, there is provided a method for synchronizing the feeding of a sheet from a first sheet position within a first feed mechanism to a second sheet position within a second feed mechanism with the feeding of a developed image from a first image position within the second feed mechanism to a second image position within the second feed mechanism. The second sheet position is adjacent to the second image position for transferring the developed image to the sheet. The method includes the steps of driving the first feed mechanism with a first drive means, driving the second feed mechanism with a second drive means, measuring the rate of motion of the first drive means, calculating a first drive means time per unit motion ratio from the rate of motion of the first drive means, measuring the rate of motion of the second drive means, calculating a second drive means time per unit motion ratio from the rate of motion of the second drive means, calculating a ratio of the rate of motion of the first drive means to the rate of motion of the second drive means, translating the sheet at a first time from the first sheet position with the first feed mechanism toward the second feed mechanism, measuring the motion of the first drive means as it translates the sheet toward the second feed mechanism to determine a first drive sheet motion, placing the sheet in cooperation with the second feed mechanism, translating the sheet with the second feed mechanism toward the second sheet position, measuring the motion of the second drive means as it translates the sheet toward the second sheet position, and utilizing the ratio of the rate of motion of the first drive means to the rate of motion of the second drive means to convert the motion of the second drive means as it translates the sheet toward the second sheet position into an equivalent second drive sheet motion of the first drive means. The method further includes the steps of translating the developed image at a second time from the first image position with the second feed mechanism to the second image position, measuring the motion of the second drive means as it translates the developed image toward the second image position, utilizing the ratio of the rate of motion of the first drive means to the rate of motion of the second drive means to convert the motion of the second drive means as it translates the first image position to the second image position into an equivalent image motion of the first drive means, converting the first drive sheet motion and the equivalent second drive sheet motion and the equivalent image motion to the first sheet time and the second sheet time, and first image time, respectively. The method further includes the steps of utilizing the first drive means time per unit motion ratio and the second drive means time per unit motion ratio and adjusting the first time with respect to the second time to provide for a time delay therebetween to compensate for the differences between sum of the first and second sheet time and first image time in order that the image and the sheet arrive at the second position simultaneously.

In accordance with yet another aspect of the present invention, there is provided a method for synchronizing the feeding of a sheet from a first sheet position within a first feed mechanism to a second sheet position within a second feed mechanism with the feeding of a developed image from a first image position within the second feed mechanism to a second image position within the second feed mechanism. The second sheet position is adjacent to the second image position for transferring the developed image to the sheet. The method includes the steps of driving the first feed mechanism with a first motor at a first speed, the first motor adapted to provide a plurality of equally spaced first motor signals with each rotation of the motor, and driving the second feed mechanism with a second motor at a second speed. The second motor is adapted to provide a plurality of equally spaced second motor signals with each rotation of the second motor. The method further includes the steps of calculating a speed ratio of the first speed to the second speed, releasing the sheet into cooperation with the first feed mechanism at a first time at the first sheet position, and translating the sheet from the first sheet position with the first feed mechanism toward the second feed mechanism. The method further includes the steps of counting first motor sheet signals of the first motor as the first motor translates the sheet toward the second feed mechanism to determine a first motor sheet signal count, placing the sheet in cooperation with the second feed mechanism, translating the sheet with the second feed mechanism toward the second sheet position, counting second motor sheet signals of the second motor as the second motor translates the sheet toward the second sheet position to determine a first motor signal count, measuring the motion of the second motor as it translates the sheet toward the second sheet position to determine a second motor sheet signal count, translating the developed image at a second time from the first image position with the second feed mechanism to the second image position, measuring the motion of the second drive means as it translates the developed image toward the second image position, counting second mechanism image signals of the second motor as the second motor translates the image toward the second image position to determine a second motor image signal count, utilizing the speed ratio to convert the second motor sheet signal count into an equivalent second first motor sheet signal count, utilizing the speed ratio to convert the second motor image signal count into an equivalent first motor image signal count, comparing the first and second first motor sheet signal count to the second motor image signal count to obtain a release count, and converting the release count into one of a time delay and a time advance corresponding to the difference between the first time and the second time, in order that the image arrives at the second image position and the sheet arrives at the second sheet position simultaneously.

In accordance with yet another aspect of the present invention, there is provided a printing apparatus for synchronizing the arrival of a copy sheet and a developed image at an image transfer position. The printing apparatus includes a first feed mechanism for translating the copy sheet. The first feed mechanism defines a first sheet feed position. The printing apparatus also includes a second feed mechanism having a copy sheet path for translating the copy sheet and a developed image path for translating the developed image. The printing apparatus also includes a first driver operably associated with the first feed mechanism for driving the first sheet feeding apparatus. The printing apparatus also includes a second driver operably associated the second sheet feeding apparatus for driving the second sheet feeding apparatus and a controller for calculating the distance the sheet traverses while influenced by one of the first driver and the second driver based at least partially upon the-motion of the other of at least one of the first driver and the second driver.

For a general understanding of the present invention, as well as other aspects thereof, reference is made to the following description and drawings, in which like reference numerals are used to refer to like elements, and wherein.

It is, therefore, apparent that there has been provided in accordance with the present invention, a modular control assembly that fully satisfies the aims and advantages hereinbefore set forth.

While the present invention will be described with a reference to preferred embodiments thereof, it will be understood that the invention is not to be limited to these preferred embodiments. On the contrary, it is intended that the present invention cover all alternatives, modifications, and equivalents as may be included within the spirit and scope of the invention as defined by the appended claims. Other aspects and features of the present invention will become apparent as the description proceeds.

Figure 1:
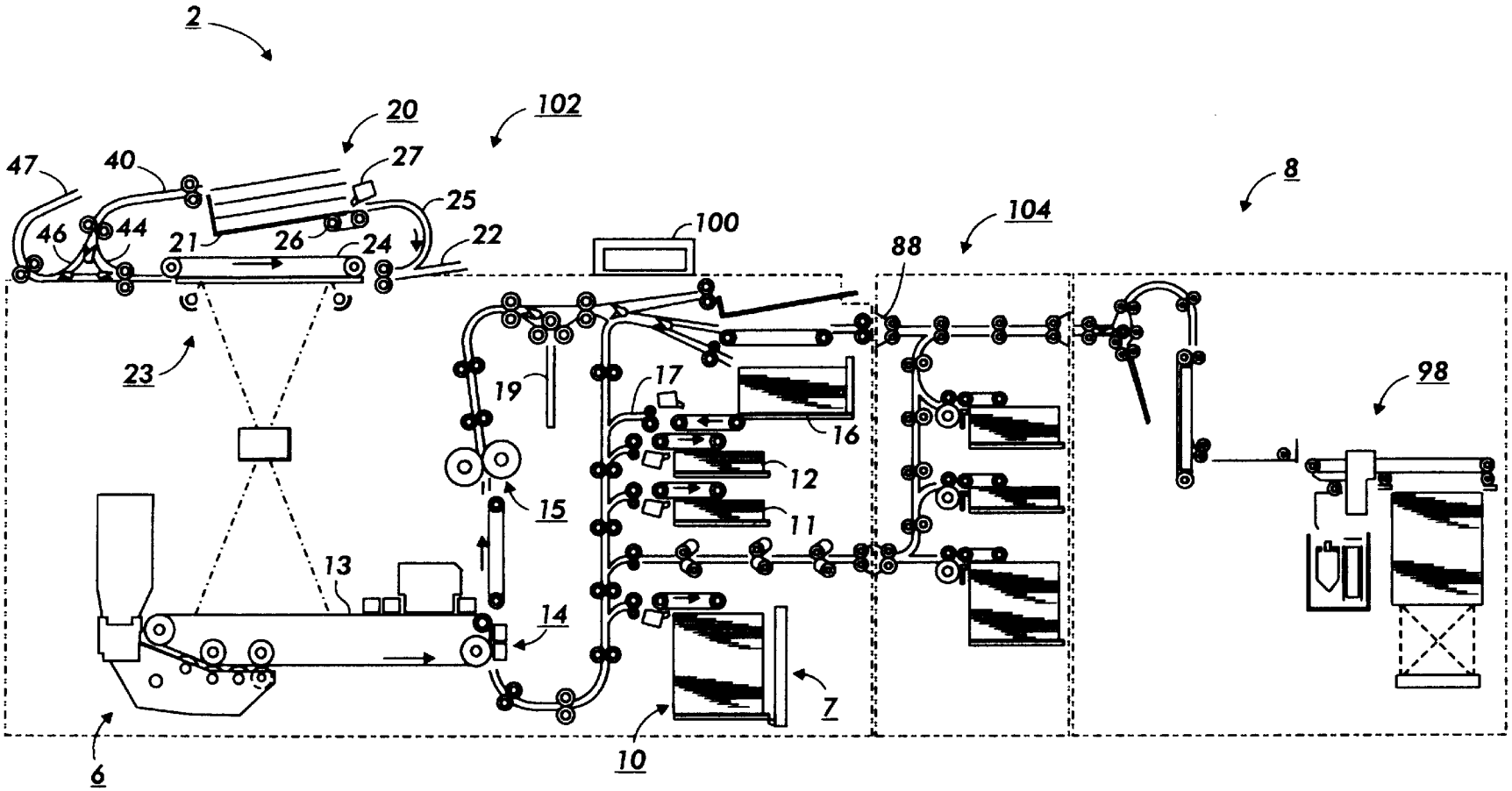
FIG. 1 is a schematic view illustrating the principal mechanical components and paper path of the printing system incorporating the synchronized paper feeding across module boundaries of the present invention.

Inasmuch as the art of electrostatographic processing is well known, the various processing stations employed in a typical electrostatographic copying or printing machine of the present invention will initially be described briefly with reference to FIG. 1. It will become apparent from the following discussion that the paper feeding system of the present invention is equally well suited for use in a wide variety of other electrophotographic or electronic printing systems, as for example, ink jet, ionographic, laser based exposure systems, etc.

In FIG. 1, there is shown, in schematic form, an exemplary electrophotographic copying system 2 for processing, printing and finishing print jobs in accordance with the teachings of the present invention. For purposes of explanation, the copying system 2 is divided into a xerographic processing or printing section 6, a sheet feeding section 7, and a finishing section 8. The exemplary electrophotographic copying system 2 of FIG. 1 incorporates a recirculating document handler (RDH) 20 of a generally known type, which may be found, for example, in the well known Xerox Corporation models "1075", "5090" or "5100" duplicators. Such electrostatographic printing systems are illustrated and described in detail in various patents cited above and otherwise, including U.S. Pat. No. 4,961,092, the principal operation of which may also be disclosed in various other xerographic or other printing machines.

A printing system of the type shown herein is preferably adapted to provide, in a known manner, duplex or simplex collated print sets from either duplex or simplex original documents circulated by a document handler. As is conventionally practiced, the entire document handler unit 20 may be pivotally mounted to the copier so as to be liftable by an operator for alternative manual document placement and copying. In this manner, the exemplary printing system or apparatus 2 is designed to receive input documents as manually positioned on an optically transparent platen or automatically positioned thereon via a document handler, such as a recirculating document handler (RDH) 20, via a document handler input tray 21 or a document feeder slot 22.

The RDH 20 operates to automatically transport individual registered and spaced document sheets into an imaging station 23, platen operatively associated with the xerographic processing section 6. A platen transport system 24 is also provided, which may be incrementally driven via a non-slip or vacuum belt system controlled by a system controller 100 for stopping the document at a desired registration (copying) position in a manner taught by various references known in the art.

The RDH 20 has a conventional "racetrack" document loop path configuration, which preferably includes generally known inverting and non-inverting return recirculation paths for transporting original input documents back to the RDH loading and restacking tray 21. An exemplary set of duplex document sheets is shown stacked in this document tray 21. For clarity, the illustrated document and copy sheets are drawn here with exaggerated spacing between the sheets being stacked; in actual operation, these stacked sheets would be directly superposed upon one another. The RDH 20 may be a conventional dual input document handler, having an alternative semiautomatic document handling (SADH) side loading slot 22. Documents may be fed to the same imaging station 23 and transported by the same platen transport belt 24 from either the SADH input slot 22 at one side of the RDH 20, or from the regular RDH input, namely the loading or stacking tray 21, situated on top of the RDH unit. While the side loading slot 22 is referred to herein as the SADH feeding input slot 22, this input feeder is not limited to semi-automatic or "stream feed" document input feeding, but is also known to be usable for special "job interrupt" insert jobs. Normal RDH document feeding input comes from the bottom of the stack in tray 21 through arcuate, inverting RDH input path 25 to the upstream end of the platen transport 24. Input path 25 preferably includes a known "stack bottom" corrugated feeder-separator belt 26 and air knife 27 system including, document position sensors (not shown), and a set of turn baffles and feed rollers for inverting the incoming original documents prior to imaging.

Document inverting or non-inverting by the RDH 20 is further described, for example, in U.S. Pat. Nos. 4,794,429 or 4,731,637, among others. Briefly, input documents are typically exposed to a light source on the platen imaging station 23, or fed across the platen without being exposed, after which the documents may be ejected by the platen transport system 24 into downstream or off-platen rollers and further transported past a gate or a series of gates and sensors. Depending on the position of these gates, the documents are either guided directly to a document output path and then to a catch tray, or, more commonly, the documents are deflected past an additional sensor, and into an RDH return path 40. The RDH return path 40 provides a path for leading the documents back to tray 21 so that a document set can be continually recirculated. This RDH return path 40 includes reversible rollers to provide a choice of two different return paths to the RDH tray 21: a simplex return path 44 which provides sheet or document inversion or a reversible duplex return path 46 which provides no inversion, as will be further explained. For the duplex path 46, the reversible rollers are reversed to reverse feed the previous trail edge of the sheet back into the duplex return path 46 from an inverter chute 47. This duplex return path 46 provides for the desired inversion of duplex documents in one circulation as they are returned to the tray 21, for copying opposite sides of these documents in a subsequent circulation or circulations, as described in the above cited art. Typically, the RDH inverter and inversion path 46, 47 are used only for documents loaded in the RDH input tray 21 and for duplex documents. In normal operation, a duplex document has only one inversion per circulation (occurring in the RDH input path 25). By contrast, in the simplex circulation path there are two inversions per circulation, one in each of the paths 24 and 44, whereby two inversions per circulation is equivalent to no inversion such that simplex documents are returned to tray 21 in their original (face up) orientation via the simplex path 44.

The entire stack of originals in the RDH tray 21 can be recirculated and copied to produce a plurality of collated copy sets. In addition, the document set or stack may be recirculated through the RDH any number of times in order to produce any desired number of collated duplex print sets, that is, collated sets of duplex copy sheets, in accordance with various instruction sets known as print jobs which can be programmed into a controller 100, to operator which will be described.

Since the copy or print operation and apparatus of the present invention is well known and taught in numerous patents and other published art, the system will not be described in detail herein. Briefly, blank or preprinted copy sheets are conventionally provided by sheet feeder section 7, whereby sheets are delivered from a high capacity feeder tray 10 or from auxiliary paper trays 11 or 12 for receiving a copier document image from photoreceptor 13 at transfer station 14. In addition, copy sheets can be stored and delivered to the xerographic processing section 6 via auxiliary paper trays 11 or 12 which may be provided in an independent or stand alone device coupled to the electrophotographic printing system 2. After a developed image is transferred to a copy sheet, an output copy sheet is delivered to a fuser 15, and further transported to finishing section 8 (if they are to be simplex copies), or, temporarily delivered to and stacked in a duplex buffer tray 16 if they are to be duplexed, for subsequent return (inverted) via path 17 for receiving a second side developed image in the same manner as the first side. This duplex tray 16 has a finite predetermined sheet capacity, depending on the particular copier design. The completed duplex copy is preferably transported to finishing section 8 via output path 88. An optionally operated copy path sheet inverter 19 is also provided.

All document handler, xerographic imaging sheet feeding and finishing operations are preferably controlled by a generally conventional programmable controller 100. The controller 100 is additionally programmed with certain novel functions and graphic user interface features for the general operation of the electrostatographic printing system 2 and the dual path paper feeder of the present invention. The controller 100 preferably comprises a known programmable microprocessor system, as exemplified by the above cited and other extensive prior art (i.e., U.S. Pat. No. 4,475,156, and its references), for controlling the operation of all of the machine steps and processes described herein, including actuation of the document and copy sheet feeders and inverters, gates, etc. As further taught in the references, the controller 100 also conventionally provides a capability for storage and comparison of the numerical counts of the copy and document sheets, the number of documents fed and recirculated in a document or print set, the desired number of copy sets, and other functions which may be input into the machine by the operator through an input keyboard control or through a variety of customized graphic user interface screens. Control information and sheet path sensors (not shown) are utilized to control and keep track of the positions of the respective document and copy sheets as well as the operative components of the printing apparatus via their connection to the controller. The controller 100 may be conventionally connected to receive and act upon jam, timing, positional and other control signals from various sheet sensors in the document recirculation paths and the copy sheet paths. In addition, the controller 100 can preferably automatically actuate and regulate the positions of sheet path selection gates, including those gates associated with the dual path paper feeder, depending upon the mode of operation selected by the operator and the status of copying in that mode.

It shall be understood from the above description that multiple print jobs, once programmed, are scanned and printed and finished under the overall control of the machine controller 100. The controller 100 controls all the printer steps and functions as described herein, including imaging onto the photoreceptor, paper delivery, xerographic functions associated with developing and transferring the developed image onto the paper, and collation of sets and delivery of collated sets to the binder or stitcher, as well as to the stacking device 98. The printer controller 100 typically operates by initiating a sequencing schedule which is highly efficient in monitoring the status of a series of successive print jobs to be printed and finished in a consecutive fashion. This sequencing schedule may also utilize various algorithms embodied in printer software to introduce delays for optimizing particular operations.

Figure 2:
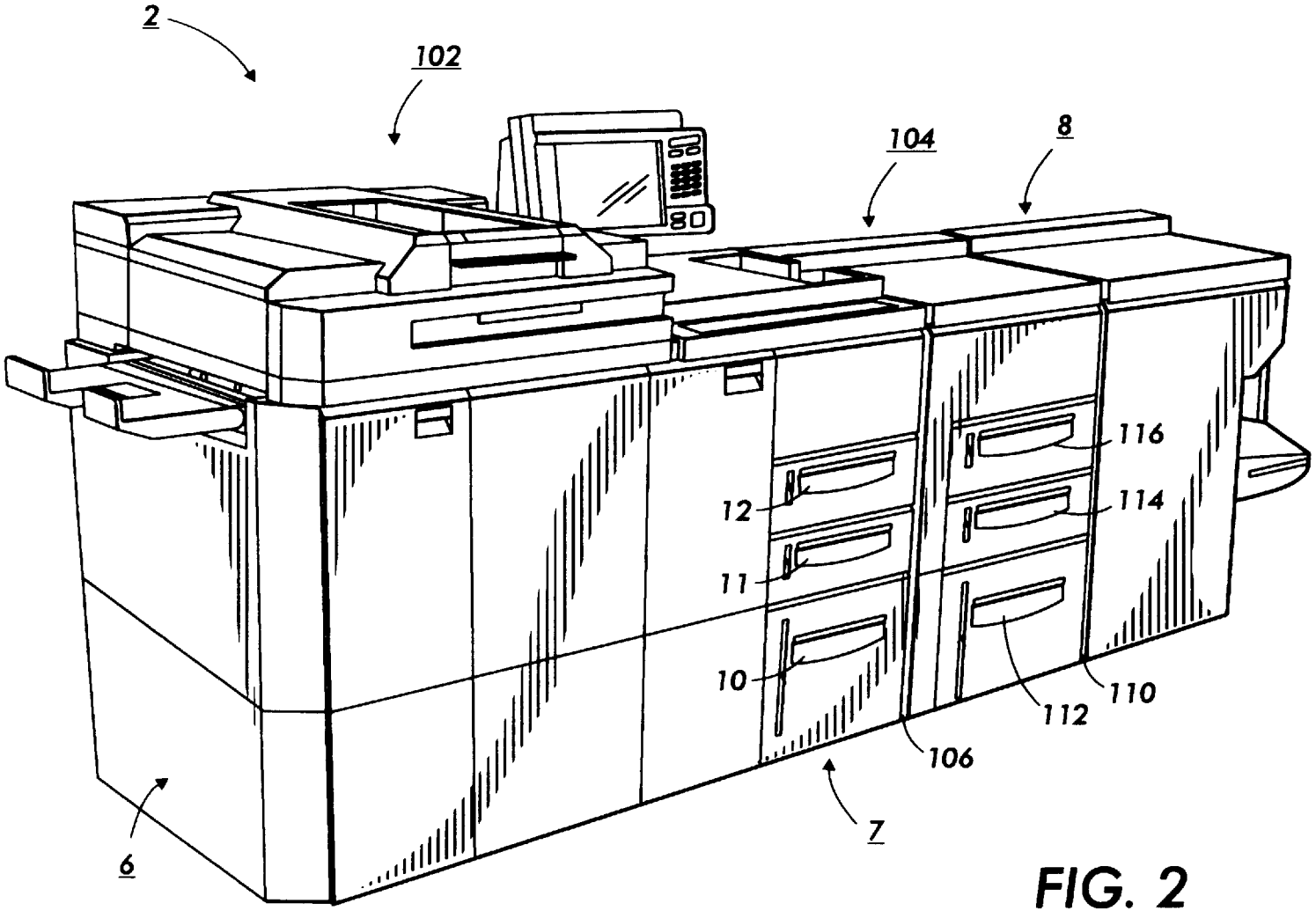
FIG. 2 is a perspective view of the electronic printing system of FIG. 1.

According to the present invention and referring to FIG. 2, a printing system 2 in the form of a copy machine is shown for utilization with a synchronized paper feeding across modular boundaries is shown. The copy machine 2 includes printer module 102 including processing section 6 and sheet feeder section 7. Adjacent printer module 102 is interposer module 104. A first module boundary 106 separates the printer module 102 from the interposer module 104. Finishing section or module 8 is positioned on the opposed side of the interposer module 104 with a second module boundary being formed between finishing section 8 and interposer module 104.

As previously mentioned, the sheet feeder section 7 includes a high capacity feed tray 12 as well as auxiliary paper trays 10 and 11. Paper within the trays 10–12 must pass through interposer module 104 on their way to the finishing section 8 thereby passing by first module boundary 106 and second module boundary 110.

Similarly, the interposer module 104 includes high capacity interposer feed tray 112, lower auxiliary interposer paper tray 114, and upper auxiliary interposer paper tray 116. The trays 112, 114 and 116 serve as sources for paper to pass either directly to the finishing section 8 or to be fed to the processing section 6 of the printer module 102 and subsequently past to the finishing section 8 through interposer module 104. Paper from the interposer paper trays 112, 114 and 116 may pass by first module boundary 106 as well as second module boundary 110.

Figure 3:
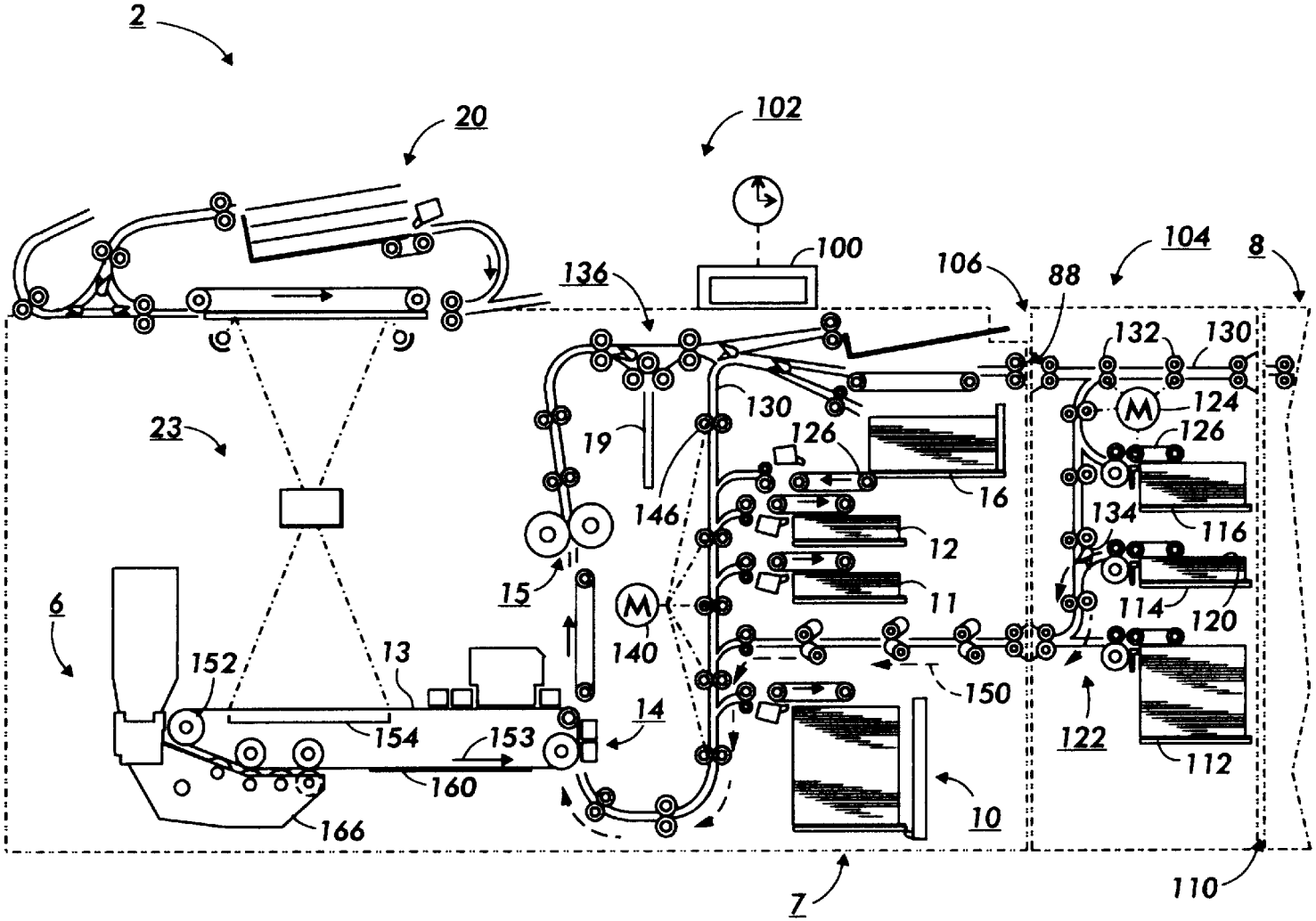
FIG. 3 is a schematic view of the paper path of the printing system of FIG. 1 incorporating the synchronized paper feeding across module boundaries of the present invention depicting the path of a sheet from first sheet position to second sheet position of a printing system.

Referring now to FIG. 3, the paper path of a copy sheet from the interposer paper feed trays is shown in greater detail. Sheets 120 within the interposer module 104 are driven by a first feed mechanism 122 including a first drive means in the form of interposer motor 124. The first feed mechanism 122 also includes sheet feed belts 126 which feed the sheets 120 from the respective trays 112, 114 and 116 toward paper guides 130 where rollers 132 drive the sheets 120 further along the first feed mechanism 122.

As shown in FIG. 3, the upper auxiliary interposer paper feed tray 116 is situated with regard to the paper guides 130 such that sheets 120 from tray 116 are fed from interposer 104 past second module boundary 110 toward finisher 8. Upper auxiliary tray 116 is used to feed preprinted sheets, tabs or dividers that do not need to be sent through the printer module 102.

High capacity interposer paper feed tray 112 is situated with respect to the paper guides 130 and roller 132 such that sheets 120 from the high capacity feed tray 112 are fed directly into the printer module 102 so that they may obtain the developed image from the xerographic process and be returned through the interposer module 104 to the finisher 8.

As shown in FIG. 3, the lower auxiliary interposer paper feed tray 114 is situated such that the paper guide 130 and rollers 132 may alternatively, by means of a diverter guide 134, either permit the sheets 120 from the lower auxiliary tray 114 to be sent directly to the finisher 8 or be first sent to the print module 102.

Sheets 120 from the lower auxiliary feed tray 112 after they have been passed through the printer module 102 pass through the interposer module 104 and finally to the finisher 8.

It should be appreciated that any of the three interposer paper trays 112, 114 or 116 may be configured to pass the sheets directly to the finisher 8, pass the sheets directly to the printer module 102 or pass the sheets 120, alternatively, to the finisher 8 or the printer module 102, as tray 114 is so configured.

When sheets 120 enter the printer module 102, are moved by second feed mechanism 136. Second feed mechanism 136 is driven by second drive means in the form of a machine motor 140. The second feed mechanism 136 includes sheet feed belts 126 as well as paper guides 130 which guide the sheets 120 as they are driven by rollers 146.

Sheets 120 as they are first moved from the sheet feed belt 126 onto the paper guide 130 and driven by rolls 132 toward first module boundary 106. Then, the sheets 120 are carried from first module boundary 106 by second feed mechanism 136 including paper guides 130 and drive rollers 146 which direct and propel the sheets 120 along paper path 150 toward photoreceptor belt 13.

Concurrently with the movement with the sheets 120, the photoreceptor belt 13 is driven by second drive motor 140 connected to photoreceptor drive roller 152. The roller 152 rotates in the direction of arrow 153 advancing latent image 154 from imaging station 23, through development station 166 and toward transfer station 14. At transfer station 14, the developed image 160 on the photoreceptor belt 13 is aligned with the sheet 120 onto which the developed image 160 is to be transferred from the photoreceptor belt 13.

It is important that the timing of the sheet 120 and the developed image 160 be coordinated such that the developed image 160 is properly registered on the sheet 120. For high speed machines with capacities of 200 sheets per minute, the translational speed of the sheet 120 along the paper path and the translational speed of the developed image 160 along arrow 153 are extremely fast, making this alignment of the sheet 120 to the developed image 160 very difficult.

Figure 4:
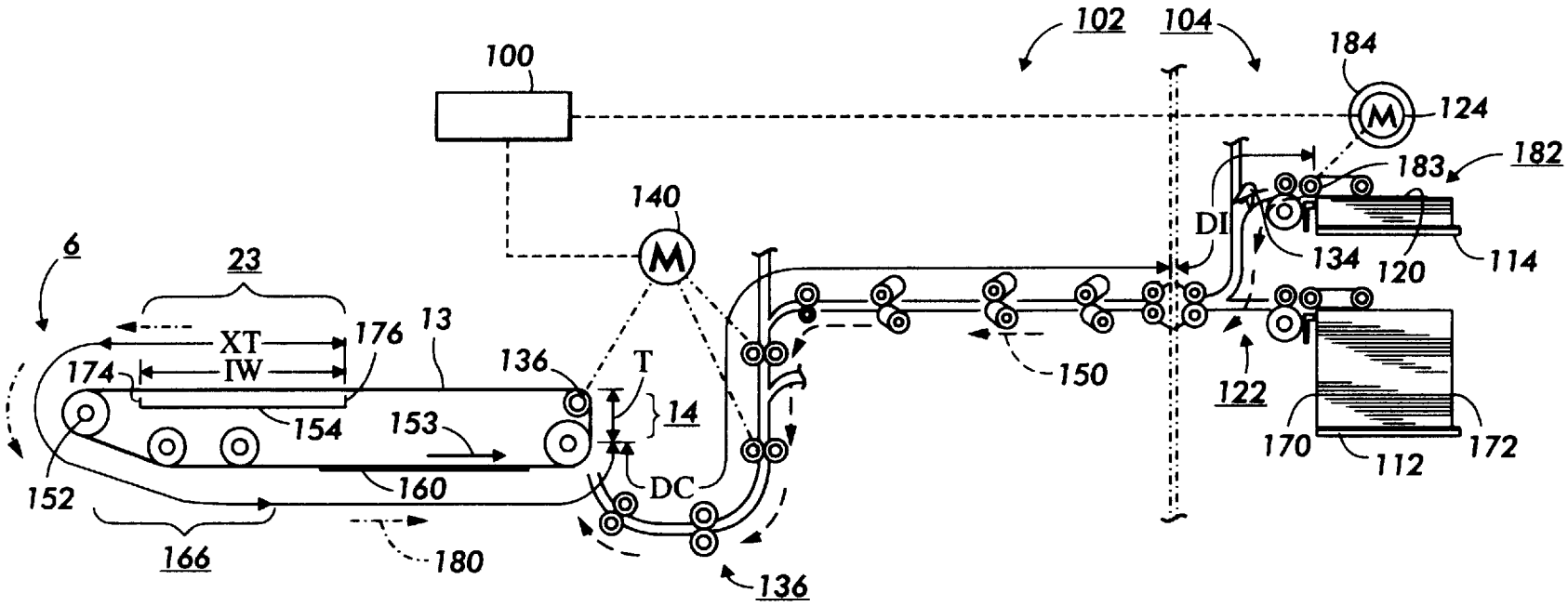
FIG. 4 is a partial schematic view of the paper path and image path of the printing system of FIG. 1 incorporating the synchronized paper feeding across module boundaries of the present invention.

Referring now to FIG. 4, the paper path 150 of the sheet 120 from the lower auxiliary feed tray 114 to the photoreceptor belt 13 is shown in greater detail. The sheet 120 is transported along paper path 150 to the transfer station 14. Similarly, latent image 154 progresses around photoreceptor belt 13 past developer unit 166 to form as a developed image 160 and then proceed to the transfer station 14 where the developed image 160 is transferred onto the sheet 120.

In most copying and printing machines, the sheets and image are both translated by a common drive means or motor. Therefore, the synchronizing of the developed image with the sheet may be simply accurately and easily controlled. However, when utilizing the interposer module 104 and the printer module 102, the separate motors for each of the modules make this synchronization much more difficult. The controller 100 serves to coordinate the feeding of the sheet 120 from the interposer 104 with the exposing and translating of the latent image 154 within the printer module 102 which is controlled by a second motor 140.

The paper path 150 has a length equal to the sum of the distance from sheet leading edge 170 to sheet trailing edge 172 having a dimension T plus the path length in the interposer module 104 having a dimension DI plus the path length in the copy handling or printer module 102 having a length DC.

Similarly, the latent image 154 has an image width IW defined by the distance between image trailing edge 176 and image leading edge 174. The latent image 154 travels from imaging station 23 to transfer station 14 a distance defined by XT as a path length of the latent image 154 to the transfer station 14. The path of the latent image 154 is defined as a marking path or image path 180. In order that the developed image 160 is synchronized with the sheet 120 as they reach the transfer station 14, the time required for the latent image 154 to move from its initial position to transfer station 14 must be either equal to the amount of time for the sheet 120 to leave from first sheet position 182 to the transfer station 14 or, if either of the motions of the developed image 160 or sheet 120 occurs more quickly than the other, either the sheet 120 or the developed image 160 must be delayed with respect to the other.

Figure 6:
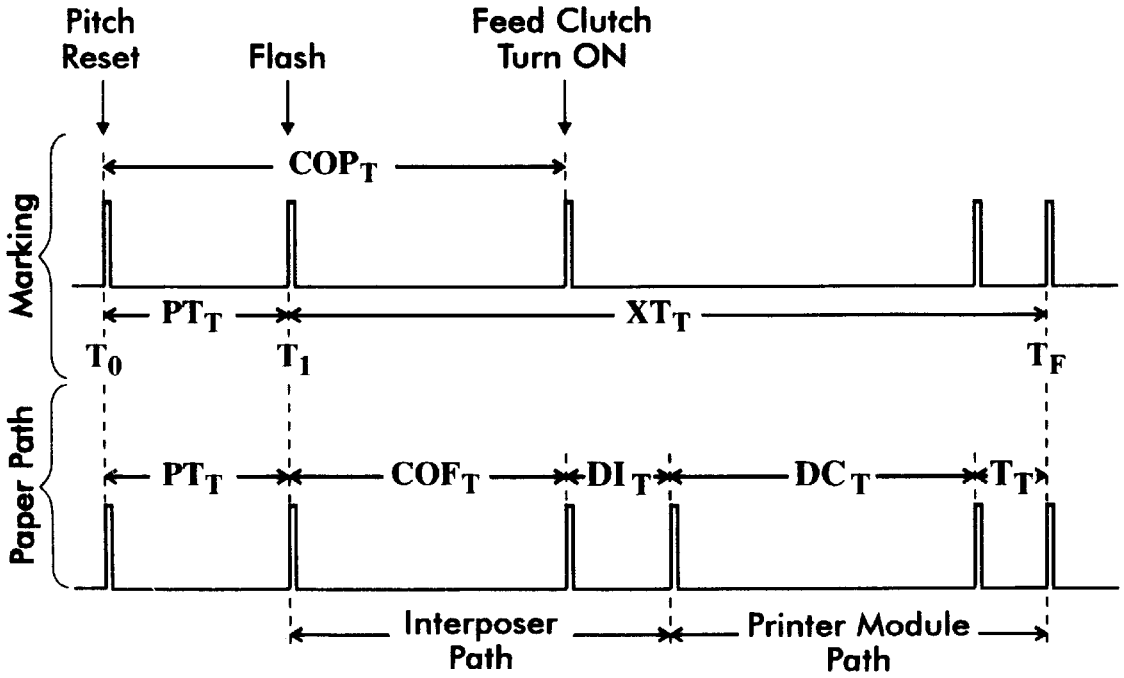
FIG. 6 is a time plot of the sheet position through the printing system of FIG. 1 incorporating the synchronized paper feeding across module boundaries of the present invention.

For example, as shown in FIG. 6, the marking path and paper path are shown plotted with respect to time. At time $T_0$, the pitch or spacing between adjacent sheets is reset. At $T_1$, a flash occurs in the printer module to create the latent image 154(see FIG. 4). At that time, the paper or sheet 120 advances toward transfer station 166 at time $T_F$. During this period, the latent image 154 travels for a time $XT_T$ to the transfer station. Since the sheet 120 may otherwise arrive at transfer station 14 prematurely, the sheet 120 is delayed from a time $T_1$ at which time the flash occurs, a time $COF_t$ after which time feed clutch 183 is energized permitting the sheet 120 to be advanced along paper path 150 (see FIG. 4).

After the clutch 183 is energized, the sheet 120 advances along paper path 150 within the interposer 104 for a time $DI_T$ to the first module boundary 106. Subsequently, the sheet 120 continues to translate along paper path 150 within the printer module 102 a length of time $DC_T$. Finally, the sheet must move for a time $T_T$ to advance the sheet 120 a distance equal to the length T of the sheet from the sheet lead edge 170 to the sheet trailing edge 172 to align with the developed image 160 at the transfer station 14. Thus, the time for the image 154 to travel from exposed station to transfer station 14 must be equal to the time for the sheet to travel along paper path 150 (the time $DI_T$ plus the time $DC_T$ plus the time $T_T$) plus the feed clutch delay time $COF_t$.

To provide for a sufficiently accurate synchronization of the sheet 120 with the developed image 160 at the transfer station 14, it is important that the timing of the delivery of the sheet 120 and the developed image 160 be very accurately controlled. Further, drive means such as motors, i.e. motors 124 and 140, of the printing machine 2, tend to vary with speed based upon current, voltage or other irregularities. The motors 124 and 140, thus, are preferably accurate motors, for example, motors that include encoders 184.

Figure 5:
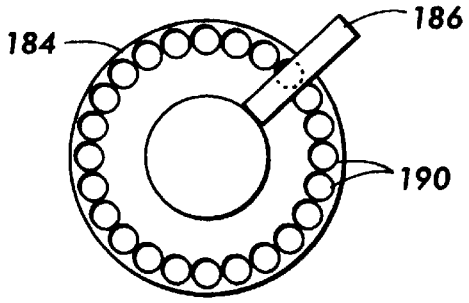
FIG. 5 is a schematic view of a rotary encoder for use in the printing system of FIG. 1.

Referring now to FIG. 5, encoder 184 is shown in greater detail. The encoder 184 typically includes a sensor 186 which measures marker indicia, say for example, opening 190, located around the periphery of the encoder. The openings 190 are equally spaced around the encoder such that with each revolution of the encoder 184, a multitude of pulses commonly called clock ticks occur with each rotation of the encoder 184.

The encoder of the interposer motor 124 emits interposer clock ticks which represent a certain rotational movement of the interposer encoder 184 equal to the distance between adjacent openings of the interposer encoder 184 and, correspondingly, the encoder of the machine motor 140 emits machine clock ticks which represent a certain rotational movement of the motor encoder 184 an identical rotational motion of the machine motor 140. Thus, for each of the clock ticks on each of the motors 124 and 140, respectively, the sheet 120 and/or the image 154 is correspondingly advanced along the respective paths 150 and 180. Thus, by premeasuring the lengths of the paper path and image path portions DI, DC, T, and XT, as well as, by determining the relative size of the drive rolls and photoreceptor belt pulleys, the clock ticks can be equated to a respective motion of the sheet 120 and developed image 160. Further, since the clock ticks occur with a generally constant rotational motor, the clock ticks correspond to a certain frequency of time.

Referring again to FIG. 4, since the interposer module 104 and the printer module 102 are preferably designed to be mostly independently constructed and operated, it is desirable that a minimal number of interconnections between the printer module 102 and the interposer module 104 be provided. Preferably, a major one of those interconnections is the pitch reset which initiates the xerographic process. Pitch reset occurs prior to the flash point when the exposure lamp (not shown) in the imaging station 23 is energized. Since the feeding of the sheets is controlled by the pitch reset, the feed clutch and flash point are preferably measured from the pitch reset. $PT_T$ represents the time from pitch reset to flash point and $COP_T$ represents the time from pitch reset to feed clutch turn on. Therefore, at a predetermined time in the xerographic cycle, the controller 100 resets the pitch. Subsequently, at the flash point, the controller 100 sends a signal to the imaging station 23 to expose the photoreceptor 13. Subsequently, a signal is sent from the controller 100 to second motor 140 whereby the photoreceptor belt 13 advances in the direction of arrow 153 transferring the latent image 164 toward transfer station 14. Subsequently, the controller 100 sends a signal to clutch 183 to engage the clutch after a predetermined delay. With engagement of the clutch 183, the first motor 124 advances the sheet 120 toward the transfer station 14 to mate with the developed image 160.

The encoder 184 of the first motor 124 of the interposer module 104 sends interposer clock ticks to the controller 100 while the encoder 184 of the second motor 140 within the printer module 102 sends copy handling clock ticks to the controller 100. The interposer clock ticks (IMC) must be equated to the copy handling clock ticks (CMC) in order for the controller 100 to properly time the copying process.

Applicant has found that a ratio of copy handling module measurement clock ticks (CMC) and interposer module measure clock ticks (IMC) can be made to determine a speed ratio(SR) or a ratio of interposer ticks per second to copy handling ticks per second.

The basic synchronizing signal common to both the interposer module 104 and the printer module 102 is pitch reset. The image is placed on the photoreceptor relative to pitch reset. The paper feeding is done relative to pitch reset as well. The feeding from any paper tray must occur so that the image lead edge and the copy paper lead edge meet at transfer. If, for example, the interposer receives only interposer clock ticks, the use of IMC as its unit of measure is preferred.

The knowledge of the relationship of copy handling clock ticks to interposer clock ticks permits the use of a single measurement unit IMC interposer machine clock ticks to control interposer feeding. This can be determined by having the copy handling module measure clock ticks per unit time and doing the same with the interposer. A ratio of the two provides the unit SR or the speed ratio. Once the machine has been up to a stable running state, the printer module 102 will measure and send a copy machine second per second value to the interposer of the controller 100. Thus, at start up of the machine, the ratio SR of interposer clock ticks to copy handler clock ticks (IMC/CMC) will be determined.

Path length of image trail edge at flash to transfer ($XT_c$) can be described by the following formula:

$$XT_c=COF_i+DC_cDI_c+T_c$$

Where:

imc=interposer module clock ticks cmc=copy handling module clock ticks $COF_i$=feed clutch turn on relative to flash (imc)

$DC_c$=path length in the copy handling module (cmc)

$DI_i$=path length in the interposer module (imc)

$T_c$=transfer time for the sheet width involved (cmc) rearranging this formula clutch turn on relative to flash (COF) can be described as follows:

$$COF_i=XT_c-DC_c-DI_i-T_c$$

but $DC_c$, $T_c$ and $XT_c$ are in cmc not imc conversion from cmc to imc can be described by the following formula:

$$SR=imc/cmc$$

Where:

SR=interposer module clock ticks per second/copy handling module clock ticks per second Converting $DC_c$, $T_c$ and $XT_c$ from cmc to imc:

Clutch turn on relative to flash (COF) can be described by the following formula:

$$COF_i=(XT_c)(SR)-(DC_c)(SR)-DI-(T_c)(SR)$$

feed clutch turn on relative to pitch reset ($COP_i$) can be described by the following formula:

$$COP_i=COF_i+PT_i$$

Where:

$PT_i$=time from pitch reset to flash (IMC)

$COP_i$=feed clutch turn on time to pitch reset time (IMC)

By utilizing the above formulations and the ratio SR of IMC to CMC, the controller 100 may operate with a common unit of measurement. The use of IMC or interposer machine clock ticks assures that the copy sheet 120 and the image 154 arrive in a synchronized manner.

The interposer feed timing is based on a mixed system. A portion of the paper travel is measured in CMC while another portion, the portion in the interposer itself, is measured in IMC. The use of clock ticks compensate for the variations over time of the two motor speeds, those of the machine motor 140 and the interposer motor 124, as well as, long term degradation due to wear of paper path components.

By providing a printing machine including an interposer that may be position between a printing module and a finisher greatly increased paper flexibility and storage capability is provided.

By providing a printing machine including an interposer having a drive motor separable from the main drive motor of the copying module, an interposer may be provided which is quickly separable and may be subsequently added easily to a printing machine.

By providing a printing machine including an interposer having a drive motor separable from the drive motor of the printing engine of the printing machine, and by determining a ratio of clock ticks between the respective rotary encoders of the respective motors, a common measurement system may be utilized to coordinate the interposer motor with the print engine motor.

By providing for interposer clock ticks to control the paper path and image path of a printing process, accurate registration can be accomplished with a minimal signal of clock ticks and pitch reset timing available at each of the printer and interposer modules.

It is, therefore, evident that there has been provided, in accordance with the present invention, an electrostatographic copying apparatus that fully satisfies the aims and advantages of the invention as hereinabove set forth. While the invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

I claim:

1. A method for tracking the position of a sheet through a paper path being moved by a plurality of feed mechanisms within a printing machine, comprising:

driving a first feed mechanism with the motion of a first drive means;

placing the sheet in cooperation with the first feed mechanism at a first position;

moving the sheet with the first feed mechanism toward a second feed mechanism;

driving the second feed mechanism with the motion of a second drive means;

placing the sheet in cooperation with the second feed mechanism at a second position;

moving the sheet with the second feed mechanism toward a sheet output position, the paper path being defined by the motion of the sheet through the first feed mechanism and the second feed mechanism from the first position to the sheet output position;

calculating the distance the sheet traverses while influenced by one of the first drive means and the second drive means based at least partially upon the motion of the other of at least one of the first drive means and the second drive means;

measuring the motion of the first drive means as it moves the sheet toward the second feed mechanism; and measuring the motion of the second drive means as it moves the sheet toward the sheet output position.

2. A method for tracking the position of a sheet through a paper path being moved by a plurality of feed mechanisms within a printing machine, comprising:

driving a first feed mechanism with the motion of a first drive means;

placing the sheet in cooperation with the first feed mechanism at a first position;

moving the sheet with the first feed mechanism toward a second feed mechanism;

driving the second feed mechanism with the motion of a second drive means;

placing the sheet in cooperation with the second feed mechanism at a second position;

moving the sheet with the second feed mechanism toward a sheet output position, the paper path being defined by the motion of the sheet through the first feed mechanism and the second feed mechanism from the first position to the sheet output position;

calculating the distance the sheet traverses while influenced by one of the first drive means and the second drive means based at least partially upon the motion of the other of at least one of the first drive means and the second drive means;

measuring the rate of motion of the first drive means;

measuring the rate of motion of the second drive means; and calculating the elapsed time to translate the sheet from the first position to the second position based on the motion of the first drive means, the rate of motion of the first drive means, the motion of the second drive means, and the rate of motion of the second drive means.

3. A method for synchronizing the feeding of a sheet from a first sheet position within a first feed mechanism to a second sheet position within a second feed mechanism with the feeding of a developed image from a first image position within the second feed mechanism to a second image position within the second feed mechanism, the second sheet position being adjacent to the second image position for transferring the developed image to the sheet, the method comprising:

driving the first feed mechanism with a first drive means;

driving the second feed mechanism with a second drive means;

measuring the rate of motion of the first drive means;

calculating a first drive means time per unit motion ratio from the rate of motion of the first drive means;

measuring the rate of motion of the second drive means calculating a second drive means time per unit motion ratio from the rate of motion of the second drive means;

calculating a ratio of the rate of motion of the first drive means to the rate of motion of the second drive means;

moving the sheet at a first time from the first sheet position with the first feed mechanism toward the second feed mechanism;

measuring the motion of the first drive means as it moves the sheet toward the second feed mechanism to determine a first drive sheet motion;

placing the sheet in cooperation with the second feed mechanism;

translating the sheet with the second feed mechanism toward the second sheet position;

measuring the motion of the second drive means as it moves the sheet toward the second sheet position;

utilizing the ratio of the rate of motion of the first drive means to the rate of motion of the second drive means to convert the motion of the second drive means as it moves the sheet toward the second sheet position into an equivalent second drive sheet motion of the first drive means;

moving the developed image at a second time from the first image position with the second feed mechanism to the second image position;

measuring the motion of the second drive means as it moves the developed image toward the second image position;

utilizing the ratio of the rate of motion of the first drive means to the rate of motion of the second drive means to convert the motion of the second drive means as it moves the first image position to the second image position into an equivalent image motion of the first drive means;

converting the first drive sheet motion and the equivalent second drive sheet motion and the equivalent image motion to the first sheet time and the second sheet time, and first image time, respectively, utilizing the first drive means time per unit motion ratio and the second drive means time per unit motion ratio; and adjusting the first time with respect to the second time to provide for a time delay therebetween to compensate for the differences between sum of the first and second sheet time and first image time in order that the image and the sheet arrive at the second position simultaneously.

4. A method for synchronizing the feeding of a sheet from a first sheet position within a first feed mechanism to a second sheet position within a second feed mechanism with the feeding of a developed image from a first image position within the second feed mechanism to a second image position within the second feed mechanism, the second sheet position being adjacent to the second image position for transferring the developed image to the sheet, the method comprising:

driving the first feed mechanism with a first motor at a first speed, the first motor adapted to provide a plurality of equally spaced first motor signals with each rotation of the motor;

driving the second feed mechanism with a second motor at a second speed, the second motor adapted to provide a plurality of equally spaced second motor signals with each rotation of the second motor;

calculating a speed ratio of the first speed to the second speed;

releasing the sheet into cooperation with the first feed mechanism at a first time at the first sheet position;

moving the sheet from the first sheet position with the first feed mechanism toward the second feed mechanism;

counting first motor sheet signals of the first motor as the first motor moves the sheet toward the second feed mechanism to determine a first motor sheet signal count;

placing the sheet in cooperation with the second feed mechanism;

moving the sheet with the second feed mechanism toward the second sheet position;

counting second motor sheet signals of the second motor as the second motor moves the sheet toward the second sheet position to determine a first motor signal count measuring the motion of the second motor as it moves the sheet toward the second sheet position to determine a second motor sheet signal count;

moving the developed image at a second time from the first image position with the second feed mechanism to the second image position;

measuring the motion of the second drive means as it moves the developed image toward the second image position;

counting second mechanism image signals of the second motor as the second motor moves the image toward the second image position to determine a second motor image signal count;

utilizing the speed ratio to convert the second motor sheet signal count into an equivalent second first motor sheet signal count;

utilizing the speed ratio to convert the second motor image signal count into an equivalent first motor image signal count;

comparing the first and second first motor sheet signal count to the second motor image signal count to obtain a release count; and converting the release count into one of a time delay and a time advance corresponding to the difference between the first time and the second time, in order that the image arrives at the second image position and the sheet arrives at the second sheet position simultaneously.

5. The method for feeding of sheets as claimed in claim 4, wherein the step of driving the first feed mechanism comprises driving the first feed mechanism with a motor including a rotary encoder.

6. The method for feeding of sheets as claimed in claim 4, wherein the step of driving the second feed mechanism comprises driving the second feed mechanism with a motor including a rotary encoder.

7. The method for feeding of sheets as claimed in claim 4, wherein the converting step comprises converting the release count into a time delay.

8. The method for feeding of sheets as claimed in claim 4, wherein, wherein the converting step comprises converting the release count into a time advance.

9. A printing apparatus for synchronizing the arrival of a copy sheet and a developed image at an image transfer position, said printing apparatus comprising:

a first feed mechanism for moving the copy sheet, said first feed mechanism defining a first sheet feed position;

a second feed mechanism having a copy sheet path for moving the copy sheet and a developed image path for translating the developed image;

a first drive means operably associated with the first feed mechanism for driving the first sheet feeding apparatus;

a second drive means operably associated the second sheet feeding apparatus for driving the second sheet feeding apparatus; and a controller for calculating the distance the sheet traverses while influenced by one of the first drive means and the second drive means based at least partially upon the motion of the other of at least one of the first drive means and the second drive means.

10. The printing apparatus as claimed in claim 9, wherein the controller is adapted to calculate the distance the sheet traverses while influenced by one of the first drive means and the second drive means based at least partially upon the motion of the other of at least one of the first drive means and the second drive means.

11. The printing apparatus as claimed in claim 9, wherein said first drive means comprises a first motor for providing a plurality of equally spaced first motor signals with each rotation of the first motor, said first motor rotating at a first speed.

12. The printing apparatus as claimed in claim 11, wherein said second drive means comprises a second motor for providing a plurality of equally spaced second motor signals with each rotation of the second motor, said second motor rotating at a second speed.

13. The printing apparatus as claimed in claim 12, wherein at least one of said first motor and said second motor comprises a rotary encoder.

14. The printing apparatus as claimed in claim 12, further comprising a clutch for engaging and disengaging the first motor with the first sheet feeding apparatus.

15. The printing apparatus as claimed in claim 14, wherein the controller is adapted for counting first motor sheet signals of the first motor as the first motor moves the sheet toward the second feed mechanism to determine a first motor sheet signal count, for counting second motor sheet signals of the second motor as the second motor moves the sheet toward the second sheet position to determine a first motor signal count measuring the motion of the second motor as it moves the sheet toward the second sheet position to determine a second motor sheet signal count, for counting second mechanism image signals of the second motor as the second motor moves the image toward the second image position to determine a second motor image signal count, for utilizing the speed ratio to convert the second motor sheet signal count into an equivalent second first motor sheet signal count, for utilizing the speed ratio to convert the second motor image signal count into an equivalent first motor image signal count, for comparing the first motor sheet signal count and second first motor sheet signal count to the second motor image signal count to obtain a release count, and for converting the release count into one of a time delay and a time advance corresponding to the difference between the first motor sheet signal count and second first motor sheet signal count, in order that the image arrives at the second image position and the sheet arrives at the second sheet position simultaneously.

16. The printing apparatus for feeding of sheets as claimed in claim 15, wherein at least one of said first feed mechanism and said second feed mechanism is located at least partially within a printing engine module detachable from a paper feeding module.

17. The printing apparatus for feeding of sheets as claimed in claim 15, wherein at least one of said first feed mechanism and said second feed mechanism is located at least partially within a paper feeding module detachable from a printing engine module.

18. The printing apparatus for feeding of sheets as claimed in claim 15, further comprising:

a plurality of sensor means for determining the position of the sheet within at least two locations within at least one of the first feed mechanism and the second feed mechanism; and clock means for determining the elapsed time for the advancement of the sheet between adjacent sensors, said controller adapted to compare elapsed time to the difference between the first motor sheet signal count and second first motor sheet signal count, and adjust the release of the sheet by the clutch in order that the image arrives at the second image position and the sheet arrives at the second sheet position simultaneously.

* * * * *